US006622517B1

(12) United States Patent
Whitlow et al.

(10) Patent No.: US 6,622,517 B1
(45) Date of Patent: Sep. 23, 2003

(54) CONDENSER ASSEMBLY HAVING READILY VARIED VOLUMETRICS

(75) Inventors: Greg A. Whitlow, Whitmore Lake, MI (US); Ian James Rawley, Chemlmsford (GB); Ramchandra Patel, Southgate, MI (US); Wen Fei Yu, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/183,926

(22) Filed: Jun. 25, 2002

(51) Int. Cl.[7] ..... F25B 43/00; F25B 39/04
(52) U.S. Cl. ..... 62/474; 62/509
(58) Field of Search ..... 62/509, 474

(56) References Cited

U.S. PATENT DOCUMENTS

| | | | | |
|---|---|---|---|---|
| 4,811,571 A | | 3/1989 | Mayer | |
| 4,911,739 A | | 3/1990 | Cullen et al. | |
| 5,088,294 A | | 2/1992 | Ando | |
| 5,159,821 A | | 11/1992 | Nakamura | |
| 5,172,758 A | | 12/1992 | Aoki | |
| 5,224,358 A | | 7/1993 | Yamanaka et al. | |
| 5,228,315 A | * | 7/1993 | Nagasaka et al. | 62/509 |
| 5,289,697 A | | 3/1994 | Hutchison | |
| 5,419,141 A | | 5/1995 | Burk | |
| 5,435,153 A | | 7/1995 | Hutchison et al. | |
| 5,537,839 A | * | 7/1996 | Burk et al. | 62/474 |
| 5,546,761 A | | 8/1996 | Matsuo et al. | |
| 5,580,451 A | | 12/1996 | Tack | |
| 5,592,830 A | | 1/1997 | Baba et al. | |
| 5,685,364 A | | 11/1997 | Harris | |
| 5,704,226 A | | 1/1998 | Beckwith et al. | |
| 5,713,217 A | | 2/1998 | Baba | |
| 5,868,002 A | | 2/1999 | Matsubayashi | |
| 5,896,754 A | | 4/1999 | Balthazard et al. | |
| 5,927,102 A | | 7/1999 | Matsuo et al. | |
| 5,934,102 A | | 8/1999 | DeKeuster et al. | |
| 5,966,810 A | | 10/1999 | Chisnell et al. | |
| 6,044,649 A | | 4/2000 | Numoto et al. | |
| 6,083,303 A | | 7/2000 | LeConey et al. | |
| 6,155,072 A | | 12/2000 | Sullivan et al. | |
| 6,170,287 B1 | | 1/2001 | Leitch et al. | |
| 6,209,348 B1 | | 4/2001 | Shinmura et al. | |
| 6,223,556 B1 | * | 5/2001 | De Keuster et al. | 62/509 |
| 6,260,379 B1 | | 7/2001 | Manwill et al. | |
| 6,267,173 B1 | | 7/2001 | Hu et al. | |
| 6,301,926 B1 | | 10/2001 | Avequin et al. | |
| 6,334,333 B1 | | 1/2002 | Shinhama | |
| 6,341,647 B1 | | 1/2002 | Nobuta et al. | |
| 6,360,560 B1 | | 3/2002 | Whitlow et al. | |
| 6,397,627 B1 | * | 6/2002 | Aki et al. | 62/509 |

FOREIGN PATENT DOCUMENTS

| | | |
|---|---|---|
| EP | 0480330 | 4/1992 |
| JP | 4-254171 | 9/1992 |

* cited by examiner

*Primary Examiner*—William C. Doerrler
(74) *Attorney, Agent, or Firm*—Brinks, Hofer Gilson & Lione

(57) ABSTRACT

A condenser assembly for a vehicle air conditioning system. The condenser assembly includes a core comprised of a plurality of parallel tubes between which are located a plurality of fins. A pair of headers are located on opposite ends and in fluid communication with the tubes of the core. The headers are constructed such that their primary components exhibit constant cross sectional profiles along their lengths. This enables the volumetrics of the condenser assembly to be altered with a minimal amount of tooling change over being required.

12 Claims, 5 Drawing Sheets

CONDENSER ASSEMBLY HAVING READILY VARIED VOLUMETRICS

BACKGROUND OF THE INVENTION

1. Field of the Invention

The present invention relates to a condenser assembly for a vehicle air conditioning system and, more specifically, to such a condenser assembly constructed so that the volumetrics of the condenser assembly may be readily varied thereby eliminating or substantially reducing the tooling cost associated with redesigning the condenser assembly for volumetric variations.

2. Description of Related Art

Condenser assemblies for automotive vehicle air conditioning systems typically include a pair of headers and a core having a plurality of tubes, through which refrigerant flows, disposed horizontally between the two headers. An inlet is disposed near an upper portion of one of the headers and an outlet is disposed at the lower portion of either the same or the other header. Within the headers, partitions may be provided to divide the interior space of the headers into more than one fluidically separate spaces. As a result, the refrigerant is caused to flow in a serpentine fashion making more than one path through the tubes between the headers.

Typically attached to one of the headers and in fluid communication therewith is a receiver. Refrigerant condensed in the core flows into the receiver where it is separated into gas and liquid portions. Since the presence of water in the refrigerant will degrade the performance and structural integrity of the air conditioning system, a dryer is often associated with or located within the receiver. The dryer is located within the receiver so that the dryer is in contact with the liquid portion of the refrigerant facilitating the removal of water from the refrigerant. The dryer may itself be comprised of a bag or cartridge containing a dryer granulate such as desiccant.

More recent designs of condenser assemblies have integrated the receiver/dryer with one of the headers mentioned above. One method of doing this has been to locate a plate within the header so as to divide the header into a manifold portion and a receiver/dryer portion. One drawback of this construction is that the design requires, for structural integrity of the system, a center line alignment of the core and the header containing the integrated receiver/dryer. Another drawback of this construction is that the joint between the manifold portion and the receiver/dryer portion cannot be inspected after brazing from the outside of the header. A further drawback is that once the tooling has been designed and constructed for such a condenser assembly, it is expensive to modify the tooling in order to provide the necessary parts with different partition locations, refrigerant communication hole locations, and volume changes of the various components of the condenser assembly, including a number of tubes in the core, as well as the lengths of the headers, the manifold portion and the receiver/dryer portion.

In other designs where the header is not internally divided to define a manifold portion and the receiver dryer, the problem remains whereby tooling flexibility is lacking and design changes relating to the volumetrics of the condenser assembly are expensive and time consuming to accommodate.

SUMMARY OF THE INVENTION

In view of the above it can be seen that there exists a need to provide a condenser assembly whose construction readily allows for the changing of the volumetrics in the assembly without incurring substantial costs and time involved in tooling a change over.

In achieving the above object, the present invention provides a condenser assembly for use in the air conditioning system of an automotive vehicle. The condenser assembly includes a core containing a plurality of tubes positioned generally horizontally and parallel to one another. The tubes accordingly define a space between adjacent ones thereof. Located within each of these spaces is a corrugated fin. The fin is in contact with both of the adjacent tubes and may be provided with louvers so as to aid in heat transfer from the refrigerant through the tubes, to the fins and, finally, to air passing through the core. On opposite sides of the core are provided a pair of headers. These headers are each in fluid communication with the tubes of the core.

The first header is configured such that refrigerant both enters and exits the condenser assembly through this header. Other locations for the refrigerant entrance and exit can be employed. The header is principally constructed from a cylindrical body having a constant cross sectional profile along its length. The open ends of the cylindrical body are closed by caps so as to define a cavity within the header. The cavity itself is divided by a partition into an upper and lower part.

The header on the opposing end of core includes two portions, a manifold portion and a receiver/dryer portion. The receiver/dryer portion is constructed of a cylindrical body having a constant cross sectional profile along its length. The ends of this cylindrical body are also closed off by caps so as to define a cavity within the receiver/dryer portion. The manifold portion is formed from another member having a constant cross sectional profile along its length. This member engages the exterior surface of the cylindrical body of the receiver/dryer portion and cooperates therewith to define a manifold chamber therein. The upper and lower most ends of the manifold chamber are closed off by partitions that extend between the manifold member and the cylindrical body of the receiver/dryer portion. Internally of the manifold chamber, an additional partition is provided to divide the manifold chamber into an upper part and a lower part. The lower part generally corresponding with the lower part of the other header. The receiver/dryer portion is further in fluid communication with the manifold portion by the formation of apertures in a generally lower end of the cylindrical body forming the receiver/dryer portion. Preferably, two apertures are provided for this communication, one being located above the partition dividing the manifold chamber into two parts and the other aperture being located below that partition.

Located within the receiver/dryer chamber is a dryer. The dryer includes dryer particulate or granulate located within a containment medium such as a permeable bag. When in contact with the liquid portion of the refrigerant being separated from the gaseous portion of the refrigerant, within the receiver/dryer portion, the particulate will remove any water that has become intermixed with the refrigerant fluid.

Prior to exiting the receiver/dryer portion, the refrigerant passes through a screen which operates to filter and remove contaminants from that fluid. This filter is incorporated into a spacer that also maintains the dryer a distance above the outlet of the receiver/dryer portion.

In preferred embodiments of the invention, the cross sectional profile of the cylindrical member of the receiver/dryer portion is round, as is the cross sectional profile of the cylindrical member of the inlet/outlet header. The cross sectional shape of the manifold member is preferably semicircular. This semicircular shape may be along a center portion of the cross section of the manifold with semicircular flanges extending therefrom so as to enable securement of the manifold member to the cylindrical body.

Other objects and advantages of the present invention will become apparent to those skilled in the technology to which the invention relates, upon a review of the detailed description, and drawings taken in conjunction with the appended claims.

DETAILED DESCRIPTION OF THE INVENTION

Figure 1:
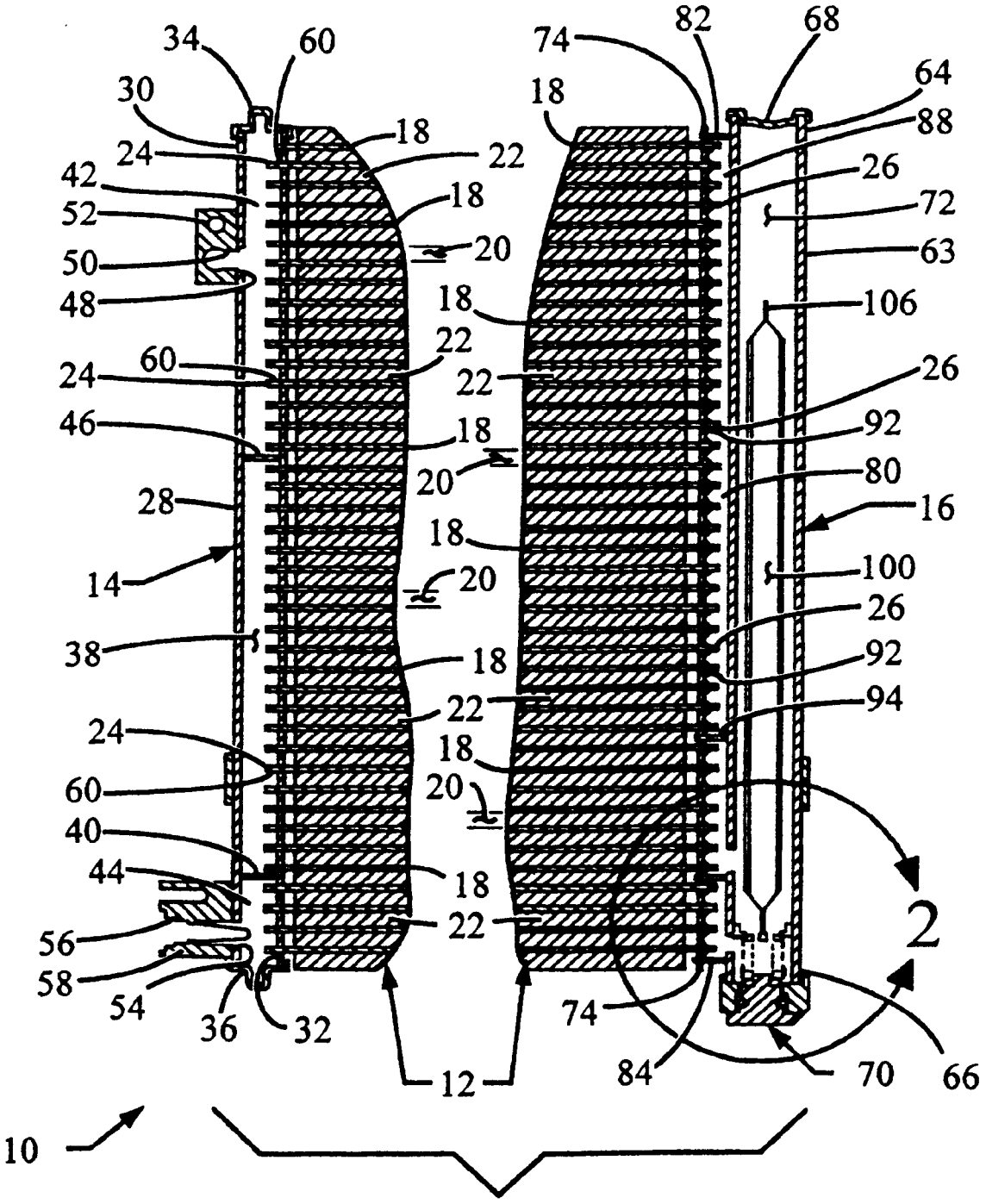
FIG. 1 illustrate a vertical section through a condenser assembly according to the principles of the present invention.

Referring now to the drawings, partially illustrated in FIG. 1 and designated at 10 is a condenser assembly embodying the principals of the present invention. The condenser assembly 10 has as its principal components a core 12 and a pair of headers 14 and 16. The headers 14 and 16 are located at opposing ends of the core 12, as further mentioned below.

The core 12 is generally seen as a tube stack comprising a series of parallel and vertically stacked tubes 18. Adjacent tubes 18 are spaced apart from one another such that a space 20 is located therebetween. The tubes 18 themselves may be of any construction now known in the industry or developed in the future. In one preferred embodiment, the tubes are generally flat and include portions defining one or more flow channels longitudinally through the tube.

Located within the space 20 between each adjacent tube 18 is a fin 22. The fins 22 exhibit a generally corrugated shape comprising a series of convolutes as is commonly known in the industry. The fins 22 generally extend completely across the space 20 contacting both the tube located thereabove and therebelow. In the figures, the details of the shape of the fins 22 are not illustrated in significant detail since those skilled in this technology will readily appreciate such a construction. Additionally, the fins 22 are preferably provided with a series of louvers on each corrugation in order to aid in the heat transfer efficiency from the tubes, to the fins and to the air passing therethrough. The fins 22 are provided in such a manner that the overall length of the tubes 18 is greater than the overall length of the fins 22 and that the ends 24 and 26 of the tubes 18 extend beyond the end of the fins 22. These ends 24, 26 of the tubes are respectively received within the headers 14 and 16 and, as further discussed below, are in fluid communication with the headers 14, 16.

The header 14 (hereinafter the "inlet/outlet header" or "I/O header" is generally seen on the left-hand side of FIG. 1. The I/O header 14 is constructed of a cylindrical body or member 28 that has a constant cross-sectional profile, round in the preferred embodiment, over its length. The top and bottom ends 30, 32 of the cylindrical body 28 are respectively engaged and closed by top and bottom caps 34, 36. The caps 34, 36 and the cylindrical body 28 therefore cooperate to define a chamber or cavity 38 within the I/O header 14. One or more partitions 40 may be located within the cylindrical body 28 so as to divide the cavity 38 into an upper portion 42 and a lower portion 44, the latter of which is sometimes referred to as a super cooling region. One or more additional partitions 46 may be provided in the upper portion 42 so as to further divide that portion into sections or parts not directly in fluid communication with each other.

Defined in the upper portion 42 of the I/O header 14 is an inlet aperture 48 that communicates with an inlet bore 50 defined in an inlet block 52. Similarly, an outlet aperture 54 is defined in the lower portion 44 of the I/O header 14 and is in communication with an outlet bore 56 defined in an outlet block 58 mounted to the cylindrical body 28 of the I/O header 14. Obviously, from the above description, refrigerant enters into the condenser assembly 10 via the inlet block 52 and exits from the condenser assembly 10 through the outlet block 58.

Located with in the outlet bore 56 of the outlet block 58 is an additional filter means 136. This filter 136 is seen in FIG. 6. Generally, this filter is of a tapered or wedge shape and is inserted into the outlet block 58 such that the narrower portion of the wedge is located in the upstream position. The filter 136 includes a base ring 138 from which extends a generally U-shaped support 140. Opposing sides of the support 140 are provided with a screen or mesh material 142. The filter 136 may be removeably retained within the outlet block 58 by mechanical interaction between the portions of the outlet block 58 and the annular base 138 of the filter 136.

In order for the cavity 38 of the I/O header 14 to fluidly communicate with the tubes 18, the end 24 of each tube 18 is received through a tube aperture 60 defined in one side of the cylindrical body 28.

The remaining header 16 of the condenser assembly 10 is generally illustrated on the right hand side of FIG. 1. This header 16 is hereinafter referred to as the "receiver/dryer header" or "R/D header". In certain respects, the R/D header 16 is constructed in a manner similar to the I/O header 14. However, the R/D header 16 itself is an integrated structure made up of two portions, a manifold portion 61 and a receiver/dryer portion 62. These portions 61, 62 will now be discussed.

The R/D header 16 is constructed with a cylindrical body or member 63 having its top and bottom ends respectively closed by top and bottom caps 68, 70. As such, the top and bottom caps 68, 70 cooperate with the cylindrical body 63 to define a cavity 72 within the R/D header 16. Along its length the cylindrical body 63 exhibits a constant cross-sectional profile (see FIGS. 3A and 3B), which, in the preferred embodiment, is round.

Figure 3A:
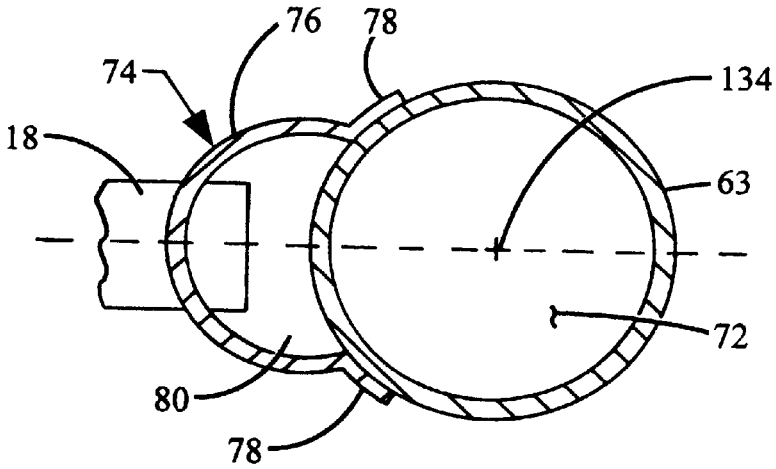
FIGS. 3A and 3B are alternate cross sectional views generally taken along line 3—3 in FIG. 2.
Figure 3B:
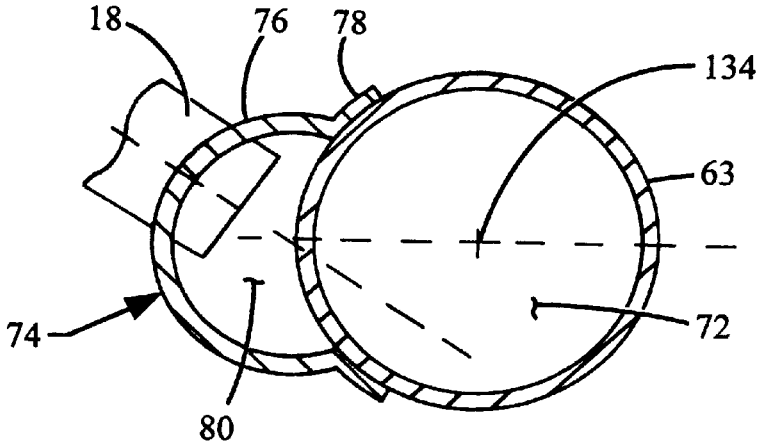

The manifold portion 61 of the R/D header 16 is defined in part by the exterior surface of the cylindrical body 63 mentioned above and in part by a manifold member 74 coupled to the cylindrical body 63. The manifold member 74 has a cross-sectional profile which is constant along its length and is also seen in FIGS. 3A and 3B. This profile, in the preferred embodiment, includes a semicircular, central portion 76 having flanges 78 extending from the ends thereof. The flanges 78 are provided with a radius of curvature corresponding with the exterior surface of the cylindrical body 63 so as to assist in securing the manifold member 74 to the cylindrical body 63 after brazing of the assembled condenser assembly 10. Prior brazing, the manifold member 74 may be retained to the cylindrical body 63 by tack welding or mechanically interacting structures, such as tabs extending beyond the flanges 78 and engaging dimples formed on the cylindrical body 63. Constructed as such, the manifold member 74 cooperates with the cylindrical body 63 to define a manifold chamber 80 therebetween. The opposing ends of the manifold chamber 80 are closed off by top and bottom partitions 82, 84 extending between the manifold member 74 and the cylindrical body 63.

Within the chamber 80, an intermediate partition 86 is provided so as to divide the chamber 80 into an upper portion 88 and a lower portion 90. The lower portion 90 corresponding to the lower portion 44 of the I/O header 14.

Figure 3C:
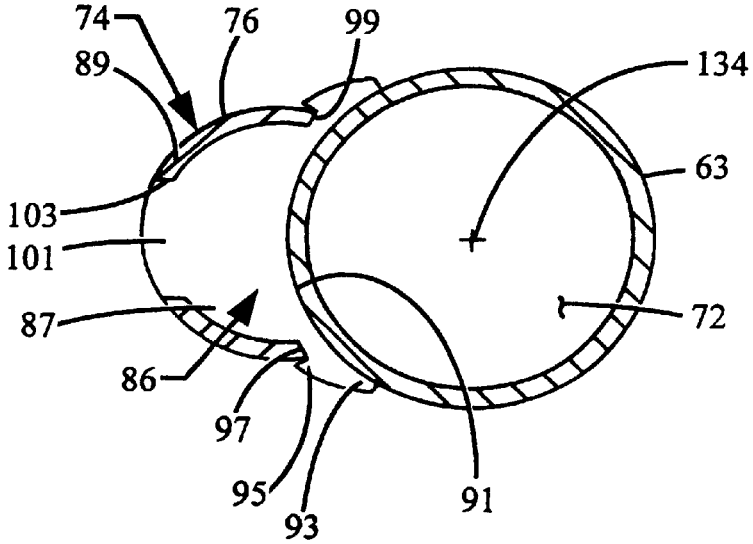
FIG. 3C is a cross sectional view across the receiver/dryer header illustrating a partition used therewith.

Referring now to FIG. 3C, a cross-sectional view taken through the R/D header 16 immediately below the intermediate partition 86, and looking upward, is illustrated therein. From this view, the shape of the intermediate partition 86 may be discerned. As seen therein, the intermediate partition 86 is provided with various features enabling it to interact with the manifold portion 72 and to facilitate the formation of a fluid tight seal between the partition 86, the manifold member 74 and the cylindrical body 63 when the condenser assembly 10 is brazed. Generally, the partition 86 includes a central portion 87 having an arcuate outer surface 89 and an arcuate inner surface 91. The radius of curvature of the outer surface 89 corresponds with the radius of curvature defined by the interior surface of the central portion 76 of the manifold member 74. The inner surface 91 exhibits a radius at curvature corresponding with the radius of curvature defined by the exterior surface of the cylindrical body 63. As mentioned above, the partition 86 is provided with various tabs. Two of these tabs are herein referred to lateral tabs 93. The lateral tabs 93 are located generally on opposing ends of the partition 86 where the inner surface 91 would otherwise have intersected with the outer surface 89, but for the presence of the lateral tabs 93. The tabs themselves define an extension of the inner surface 91 on their inner sides and are provided with shoulders 95 on their outer sides. The shoulders 95 define a recess 97. A slot 99 is defined in the manifold member 74 permitting the lateral tabs 93 to extend therethrough. As such, the portions defining the slot 99 are received within the recess 97 defined by the shoulders 95 of the lateral tabs 93. The final tab 101 of the partition 86 extends outward from the outer surface 89 of the partition 86 and extends into a slot 103 defined in the manifold member 74. It is generally centered on the outer surface 89 between the lateral tabs 93. Provided with these features, partition 86 is readily located in the manifold member 74 and the cylindrical body 63. When brazed therewith, a fluid tight seal is formed between these three components.

While the partition 86 has been described with some particularity, it should be readily understood that alternate configurations for the various tabs as well as the location of the tabs will be readily apparent based on the above. Additionally, it is noted that the top and bottom partitions 82 and 84, and additional partition 94, are preferably provided with the same construction as partition 86.

Unlike the I/O header 14, refrigerant enters and exits the R/D header 16 by way of the tubes 18. The tubes 18 themselves extend into the chamber 80 passing through tube apertures 92 defined in one side of the manifold member 74. The upper portion 88 of the chamber 80 introduces the refrigerant and may further be divided by an additional partition 94 into two parts not directly in fluid communication with one another. As a result of the various partitions 40, 46, 86, 94 during use, refrigerant is caused to pass multiple times through the tubes in a generally serpentine manner until exiting the condenser assembly 10.

Figure 2:
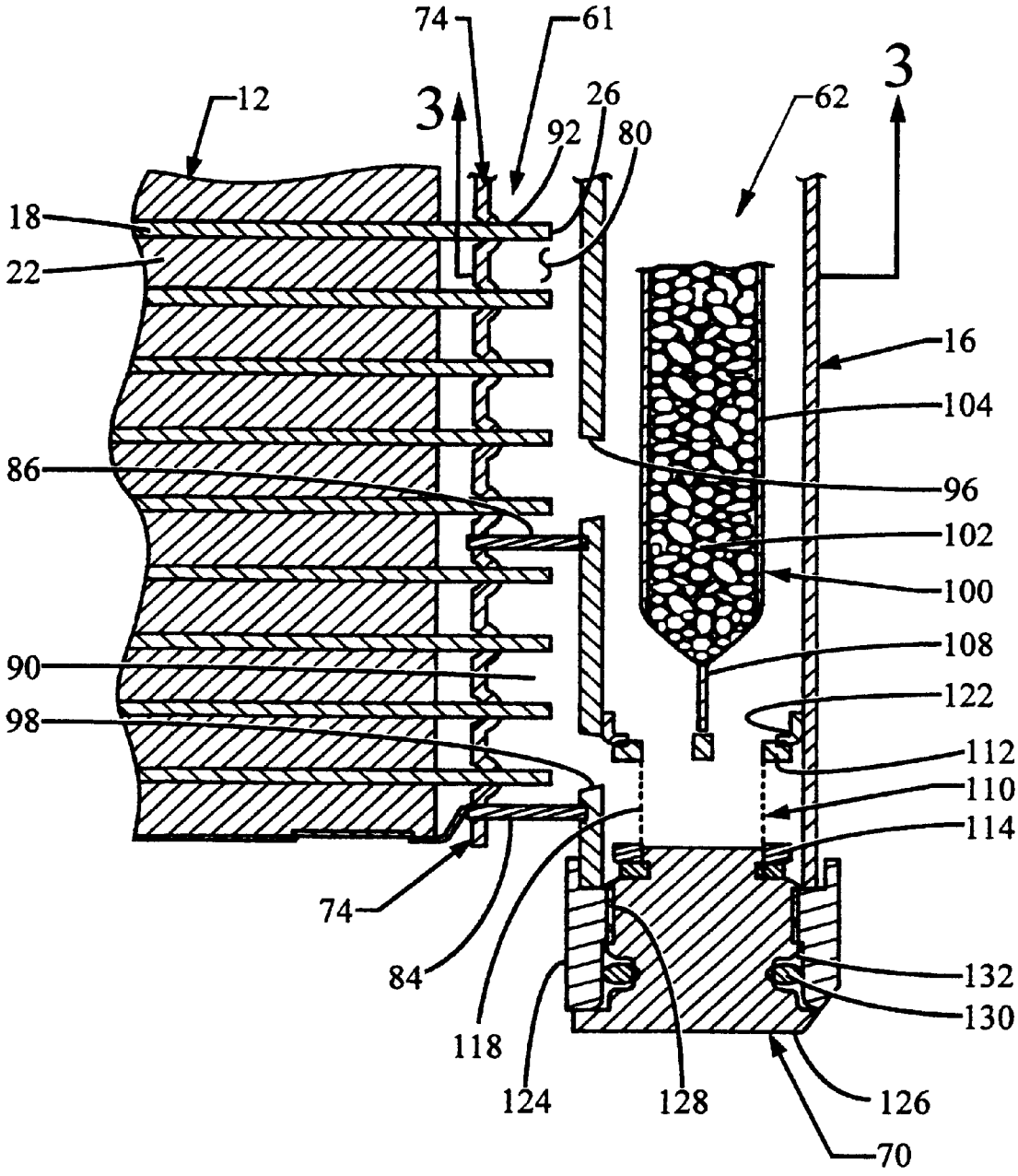
FIG. 2 is an enlarged view of that portion circumscribed by circle 2—2 in FIG. 1.

As seen in FIGS. 1 and 2, the cavity 72 and the chamber 80 of the R/D header 16 are in fluid communication with one another. To provide for this communication, an upper aperture 96 and a lower aperture 98 are respectively provided in the cylindrical body 63 at locations respectively above and below the location of the intermediate partition 86. The upper aperture 96 operates as the inlet into the cavity 72. The lower aperture 98 therefore operates as the outlet from the cavity 72.

As indicated from the discussion above, the cavity 72 of the R/D header 16 operates as the receiver/dryer chamber for the condenser assembly 10. To achieve this purpose, a dryer 100 is located within the-cavity 72 so as to be in contact with at least the liquid portion of the refrigerant contained therein. The dryer 100 may be one of a variety of known constructions whereby particulate or granular dryer material 102, such as desiccant, comes in contact with the liquid refrigerant. In the illustrated embodiment of FIG. 2, the particulate 102 is contained within a bag 104 constructed of permeable material, such as fabric. The upper and lower ends 106, 108 of the bag 104 are closed off to contain the particulate 102 therein.

The bag 100 is further located within the cavity 72 so as to be vertically spaced above the lower aperture 98 in the lower most end of the R/D portion 62. This is achieved by also providing within the cavity 72 a spacer 110.

Figure 4:
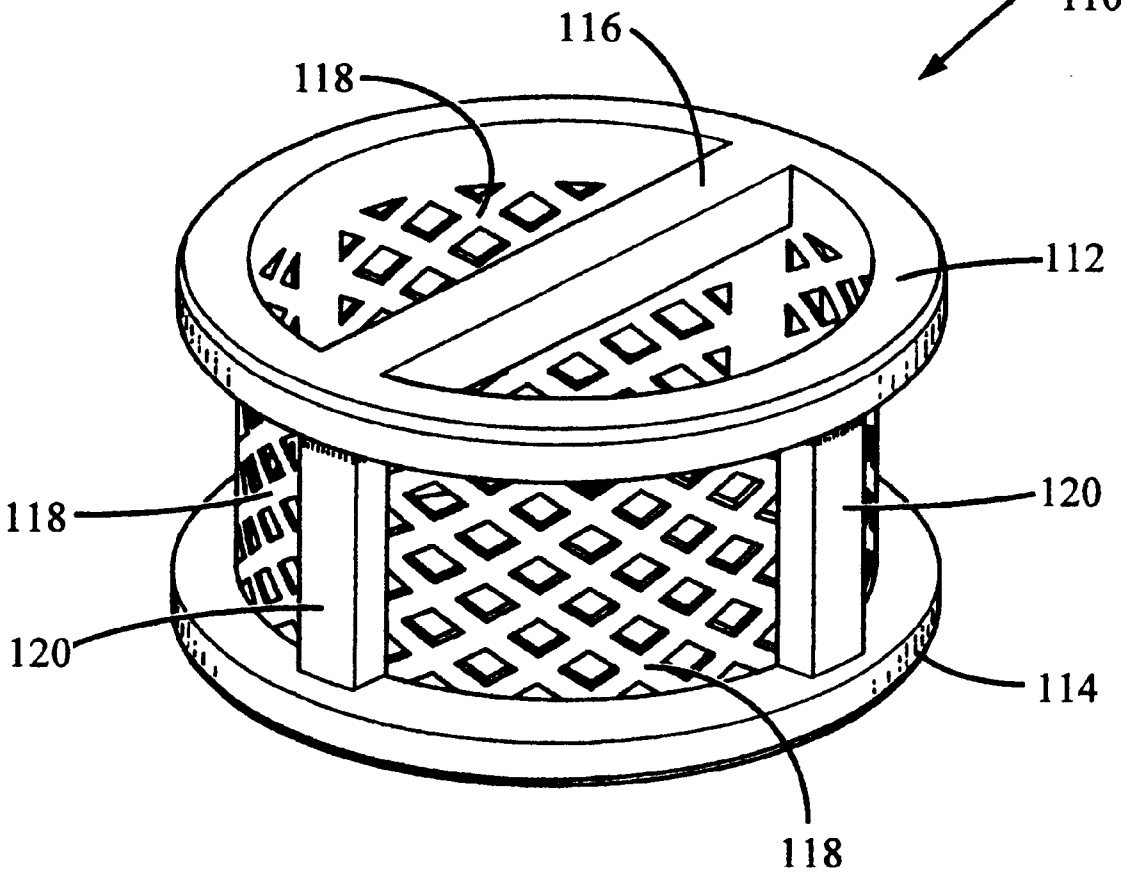
FIG. 4 is a perspective view of the spacer utilized in the receiver/dryer portion of the present invention.
Figure 5:
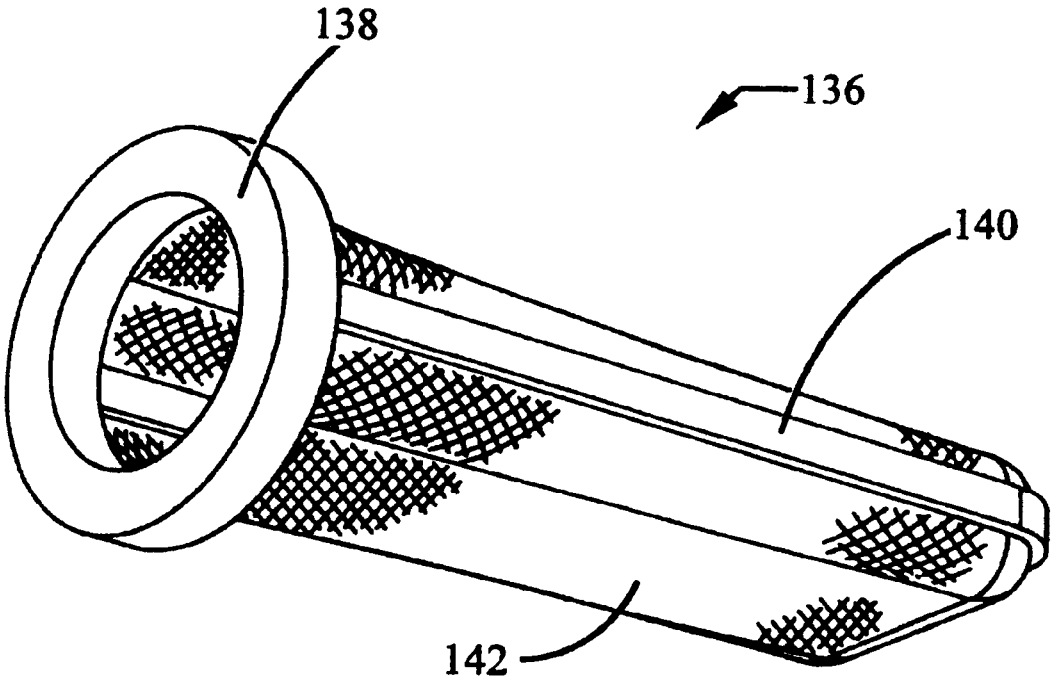
FIG. 5 is perspective view of an optional filter of an optional filter that may be utilized in the outlet of a condenser assembly according to the principles of the present invention.

As seen in FIG. 4, the spacer 110 is generally cylindrical and includes and upper rim 112 and a lower rim 114. A cross bar 116 extends diametrically across the upper rim 112. The cross bar 116, in combination with the upper rim 112, supports the dryer 100 within the R/D portion 62. Between the upper rim 112 and the lower rim 114 is a mesh 18. Because of the positioning of the spacer 110 within the chamber 117, refrigerant flowing to the lower aperture 98 passes, first, around the cross bar 116 and, then, into the central portion of the spacer 110. Refrigerant then flows outward of the spacer 110 passing through the mesh 118. The mesh 118 therefore operates as a filter for inappropriate materials within the refrigerant. In addition to the mesh 118, a series of vertical posts 120, which operate to provide additional structural integrity, extend between the upper and lower rims 112, 114.

Within the cavity 72, the spacer 110 is captured between a retention flange 122, located on the interior of the cylindrical body 63 immediately above the lower aperture 98, and the bottom cap 70.

While one piece constructions may be used, the bottom cap 70 is preferably provided with a two piece construction and includes a collar 124 in contact with the bottom end 66 of the cylindrical body 63 and a plug 126. Engagement between the plug 126 and the collar 124 is provided as a threaded engagement 128. Accordingly, internal threads are provided on the collar 124 and matching external threads are provided on the plug 126. In order to ensure a liquid tight seal between the collar 124 and plug 126, a O-ring 130 may be provided within a groove 132 formed in the plug 126. In this manner, should the dryer 100 need to be replaced during the useful life of the vehicle or should the mesh 118 at the screen 110 need to be cleaned,.the plug 126 may be disengaged from the collar 124, the spacer 110 removed from within the cavity 72 and the dryer 100 withdrawn thereout and replaced.

As mentioned in the background section above, one problem with prior condenser assembly constructions is that, should the need arise to vary the volumetric requirement and therefore the size of the condenser assembly, prior constructions were expensive and required substantial retooling on the part of the condenser manufacturer. With the present invention, the expense and time required for tooling changes is minimized. This is achieved from due to the major components of the condenser assembly 10 being constructed such that the principle change required in the components (in order to achieve volumetric changes within the condenser assembly 10) is to vary the length of the components. These components include the cylindrical body 28 of the I/O header 14, the cylindrical body 63 and the manifold member 74 of the R/D header 16. The various partitions, end caps and other components would remain the same and therefore no additional tooling changes, as a result of those components, would be necessitated. The construction is further such that the location of the various partitions and apertures permitting fluid communication between the cavities and chambers defined by the principle components may be readily relocated without substantial cost.

Another advantage of the construction of the present invention is that while the tubes 18 may be aligned with the central axis 134 extending through the cylindrical body 63 of the R/D portion 62, the present invention permits a canted or off-center construction as seen in FIG. 3B. The canted construction of FIG. 3B may prove advantageous in certain situations where packaging needs to be minimized.

It should be apparent to those skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A condenser assembly for a vehicle air conditioning system, said condenser assembly comprising:

a core including a plurality of tubes positioned generally parallel and, a plurality of fins disposed between said tubes, said tubes having flow passages defined therein and said core having opposing ends;

a first header at one end of said core and in fluid communication with said flow passages in said tubes, at least one partition located within said first header and dividing said first header into at least two parts not directly in fluid communication with each other, said first header comprising a first cylindrical member having a constant cross sectional profile and first header ends, said first header comprising header caps to close said ends; and a second header at an opposing end of said core and comprising:

a receiver/dryer portion comprising a second cylindrical member having a constant cross-sectional profile and receiver/dryer ends, and receiver/dryer caps closing said receiver/dryer ends and cooperating with said second cylindrical member to define a receiver/dryer chamber;

a manifold portion comprising flanges affixed to said receiver/dryer portion and cooperating therewith to define a manifold chamber having a generally semicircular profile in fluid communication with said flow passages in said tubes, said manifold portion further comprising manifold ends and partitions affixed to said ends separate and distinct from said receiver/dryer caps.

2. A condenser assembly according to claim 1 wherein said internal profile of said second cylindrical member is round.

3. A condenser assembly according to claim 1 wherein said constant cross-sectional profile of said first cylindrical member is round.

4. A condenser assembly according to claim 1 further comprising an inlet to introduce gas fluid thereto and an outlet to discharge a liquid fluid therefrom.

5. A condenser assembly according to claim 1 further comprising a dryer including a drying material, said dryer located within said receiver/dryer chamber.

6. A condenser assembly according to claim 5 wherein said dryer comprises a fluid permeable bag containing desiccant material therein.

7. A condenser assembly according to claim 5 wherein said dryer is supported on a spacer locating said dryer apart from said receiver/dryer ends.

8. A condenser assembly according to claim 7 wherein said spacer includes a screen, said screen adapted to filter fluid in said receiver/dryer portion.

9. A condenser assembly according to claim 1 further comprising at least one partition located within said manifold chamber and dividing said manifold chamber into at least two parts not directly in fluid communication with each other.

10. A condenser assembly according to claim 1 further comprising a refrigerant inlet for said assembly in said first header.

11. A condenser assembly according to claim 1 further comprising a refrigerant outlet for said assembly in said first header.

12. A condenser assembly according to claim 11 wherein said refrigerant outlet includes a filter located therein.

* * * * *